US010588423B1

(12) United States Patent
Adkins

(10) Patent No.: US 10,588,423 B1
(45) Date of Patent: Mar. 17, 2020

(54) FOLDING BOOSTER CHAIR

(71) Applicant: Michelle Adkins, Battleboro, NC (US)

(72) Inventor: Michelle Adkins, Battleboro, NC (US)

( * ) Notice: Subject to any disclaimer, the term of this patent is extended or adjusted under 35 U.S.C. 154(b) by 0 days.

(21) Appl. No.: 16/045,838

(22) Filed: Jul. 26, 2018

Related U.S. Application Data

(60) Provisional application No. 62/537,016, filed on Jul. 26, 2017.

(51) Int. Cl.
*A47D 1/02* (2006.01)
*A47D 15/00* (2006.01)

(52) U.S. Cl.
CPC ..... *A47D 1/023* (2017.05); *A47D 15/006* (2013.01)

(58) Field of Classification Search
CPC ..... A47D 1/023; A47D 15/006
USPC ..... 297/16.1, 16.2, 18, 25
See application file for complete search history.

(56) References Cited

U.S. PATENT DOCUMENTS 1,738,339 A * 12/1929 Whiting ..... A47D 1/008 297/41
2,627,300 A * 2/1953 Wohler ..... A47D 1/02 297/46
2,679,894 A * 6/1954 Lindsay ..... A47D 1/02 297/30
2,699,817 A * 1/1955 Adler ..... A47D 1/02 297/40
2,973,804 A * 3/1961 Gill ..... A47D 1/02 297/40
3,012,815 A 12/1961 Smith
3,072,433 A * 1/1963 Heller ..... A47D 1/002 297/40
3,495,277 A * 2/1970 Herskovich ..... A47D 1/008 4/237
4,556,249 A * 12/1985 Kassai ..... A47D 1/023 297/30
7,029,064 B2 4/2006 Chen
7,717,502 B2 5/2010 Deng
9,066,606 B1 * 6/2015 Archer-Hall ..... A47D 1/023
2005/0140182 A1 * 6/2005 Tsang ..... A47C 4/14 297/16.1
2007/0029845 A1 2/2007 Riedl et al.
2007/0040420 A1 2/2007 Li
2007/0194609 A1 8/2007 Chen
2009/0039684 A1 * 2/2009 Chen ..... A47D 1/006 297/16.1
2010/0038935 A1 * 2/2010 Walter ..... A47D 1/04 297/130
2010/0096890 A1 4/2010 Whitlock
2010/0237666 A1 9/2010 Bukavich et al.
2017/0311733 A1 * 11/2017 Winterhalter ..... A47D 1/023

* cited by examiner

*Primary Examiner* — Mark R Wendell
(74) *Attorney, Agent, or Firm* — Cramer Patent & Design, PLLC; Aaron R. Cramer

(57) ABSTRACT

A folding chair for children includes a padded chair secured above a pair of folding angular tubular legs. Each folding angular tubular leg has a centrally located folding cross-brace. A pair of armrests are disposed on either side of the chair. A teething bar is secured at teething bar end to a distal end of each armrest. A handle is perpendicularly secured to the back of the chair. The folding mechanism is actuated by a switch located within the base of the chair.

16 Claims, 3 Drawing Sheets

FOLDING BOOSTER CHAIR

RELATED APPLICATIONS

The present invention was first described in and claims the benefit of U.S. Provisional Patent Application No. 62/537,016 filed on Jul. 26, 2017, the entire disclosures of which are incorporated herein by reference.

FIELD OF THE INVENTION

The present invention relates generally to the field of folding booster chairs.

BACKGROUND OF THE INVENTION

As most people would agree, dining out at a favorite restaurant can be a nice way to relax and participate in a form of generally affordable entertainment. Whether it be a date night for a couple or a group of friends going out after work, dining out is popular. However, the dining out experiences for families, especially families with children who require booster seats or highchairs, can often be a logistical hassle, the frustration of which nearly off-sets any enjoyment the dining out experience may engender.

This is because in many instances, restaurant booster seats and highchairs are either unavailable or if available are likely not clean or the proper size. Parents or guardians in this situation have often resorted to bringing their own booster seat or highchair to the restaurant. However, many of these devices prove difficult to store in a vehicle and carry in and out of a given restaurant.

Therefore, a need exists whereby an individual or family wishing to take a baby or toddler out to eat may bring his, her or their own booster chair in a manner that is convenient and safe. The folding booster chair fulfills this purpose.

SUMMARY OF THE INVENTION

To achieve the above and other objectives, the present invention provides for an A folding booster chair having a back rest, a seat which is moveably secured to a rear side of the back rest, a first arm which is moveably secured to a first side of the back rest at a first arm first end, a second arm which is moveably secured to a second side of the back rest at a second arm first end, a first arm support which is moveably secured between the first arm at a first arm second end and a first side of the seat and adjacent a front side of the seat, a second arm support which is moveably secured between the second arm at a second arm second end and a second side of the seat and adjacent a front side of the seat opposite the first arm, a teething tube which is secured between the first arm second end and the second arm second end, a pair of legs each moveably and radially disposed beneath the rear side of the seat on opposite sides of the rear side of the seat, a pair of upper braces, each moveably and radially disposed beneath the front side of the seat on opposites sides of the front side of the seat at a respective first end of each the upper brace and moveably secured the pair of legs respectively, a pair of lower braces, each moveably and radially disposed beneath each respective the pair of legs, and a pair of cross braces, each moveably disposed between each respective the pair of legs and each the pair of lower braces.

A separate embodiment further comprises a release mechanism which is disposed within the first side of the seat. The actuation of the release mechanism engages the release of a locking mechanism permitting the booster chair to be manipulated to a folded state. The locking mechanisms are in mechanical communication with a pair of hinges. A first hinge is disposed between the seat back and the seat while the second hinge is disposed between the seat and the first leg.

The teething tube may be rotationally secured between the first arm second end and the second arm second end and may comprise a soft durable exterior material having a solid core. The safety strap may be removably secured between the teething tube and the front side of the seat.

A safety strap may be secured between the teething tube and the front side of the seat while the back rest and the seat are secured together by means of a first hinge mechanism. Furthermore, the first leg and the seat may be secured together by means of a second hinge mechanism. The second hinge mechanism may be capable of being secured in a locked position. The back rest and seat may be made of a pliable plastic surface and foam interior.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
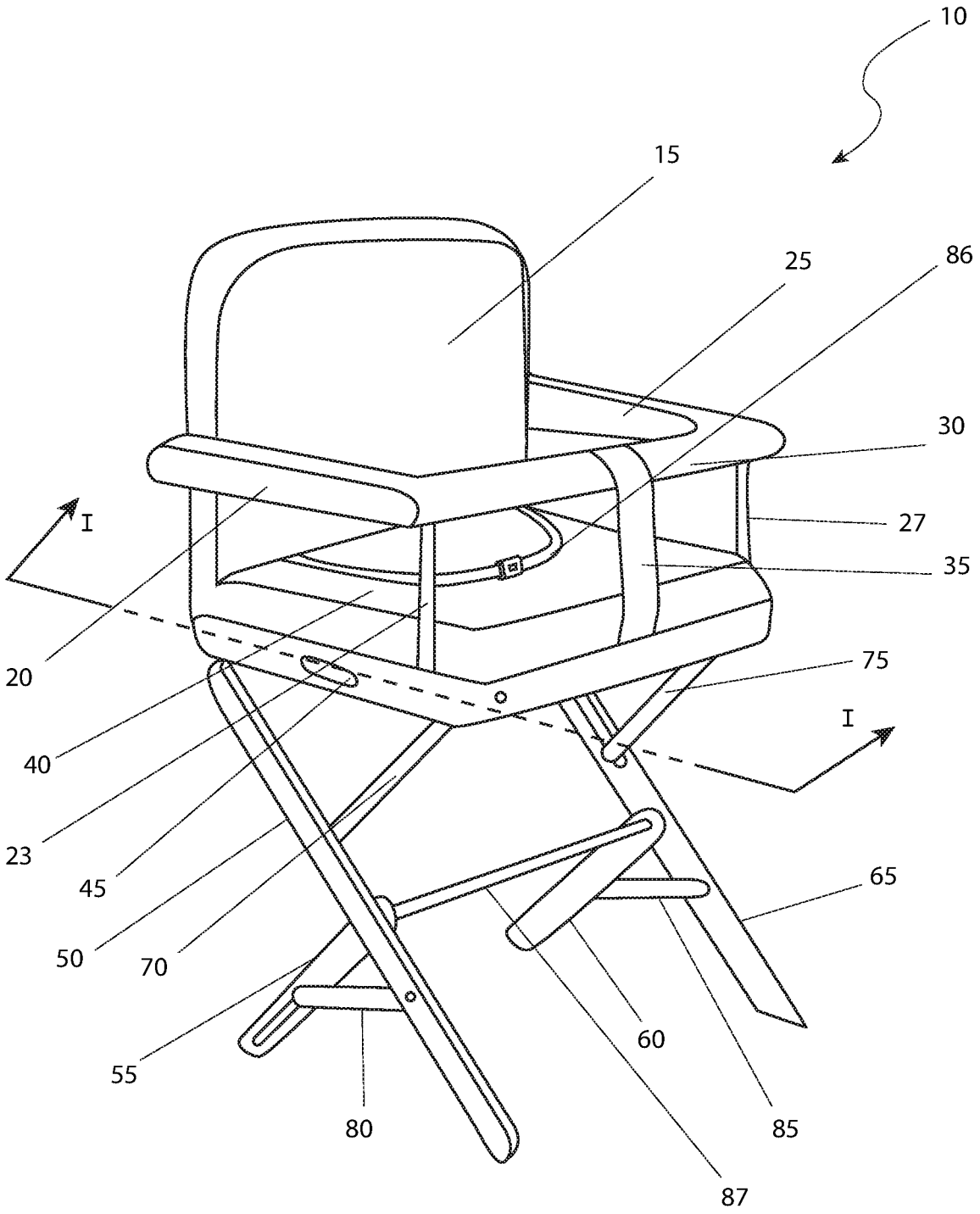
FIG. 1 is a perspective view of a folding booster chair 10, in a deployed or unfolded configuration according to a preferred embodiment of the present invention.

10 folding booster chair
15 back rest
20 first arm
23 first arm support
25 second arm
27 second arm support
30 teething tube
35 safety strap
40 seat
45 release mechanism
50 first leg
55 first lower brace
60 second lower brace
65 second leg
70 first upper brace
75 second upper brace
80 first cross brace
85 second cross brace
86 safety restraint
87 cross member support
90 first hinge mechanism
95 pivot point
100 first slide lock mechanism
105 mechanical linkage
110 second hinge mechanism
115 second slide lock mechanism
120 lower sliding track
125 upper sliding track
130 arm support sliding track

DETAILED DESCRIPTION OF THE PREFERRED EMBODIMENT

Figure 2:
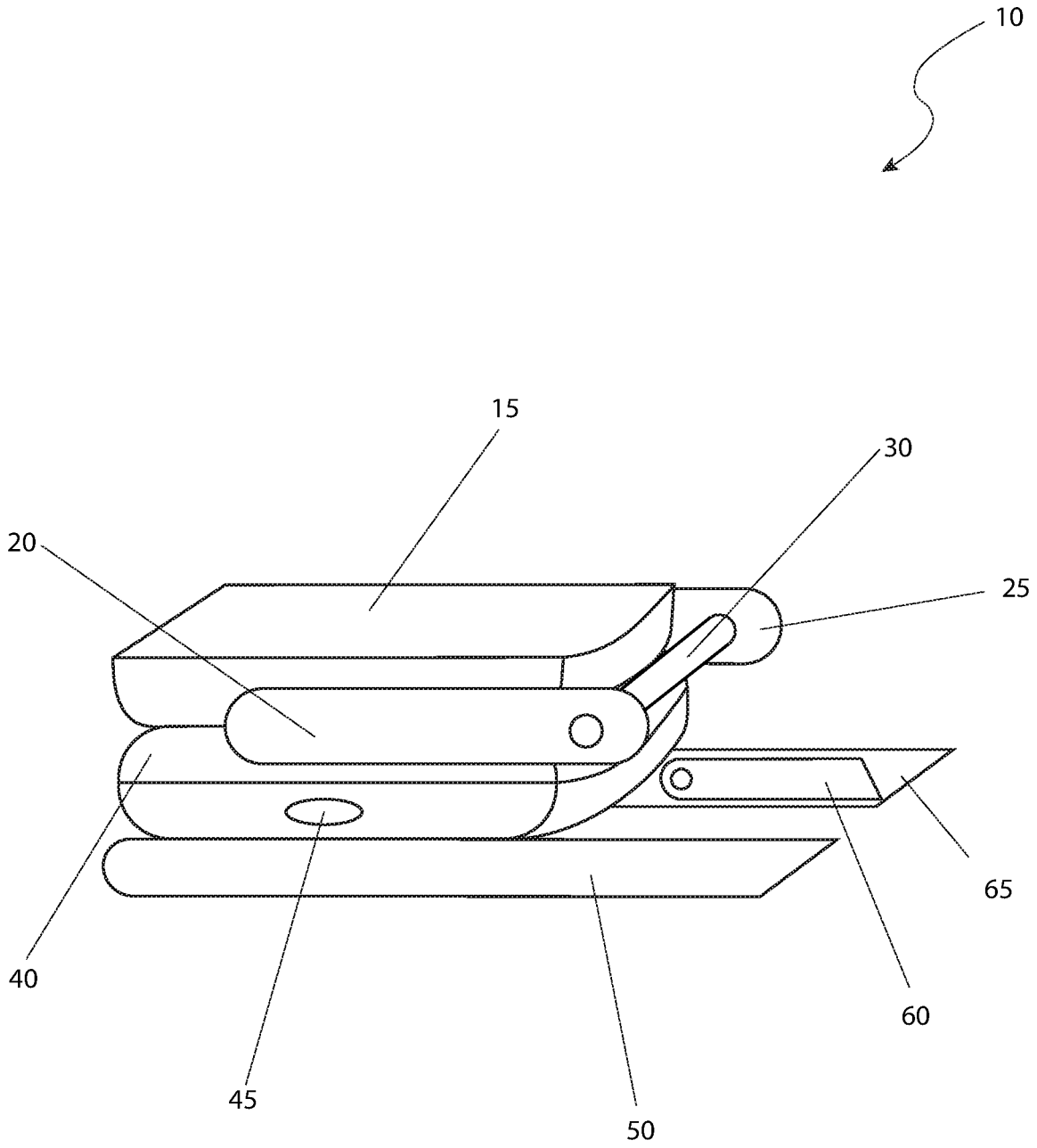
FIG. 2 is perspective view of a folding booster chair 10, in a folded or collapsed configuration according to a preferred embodiment of the present invention; and, FIG. 3 is a sectional view of a folding booster chair 10, as seen along a line I-I, as shown in FIG. 1, according to a preferred embodiment of the present invention.
Figure 3:
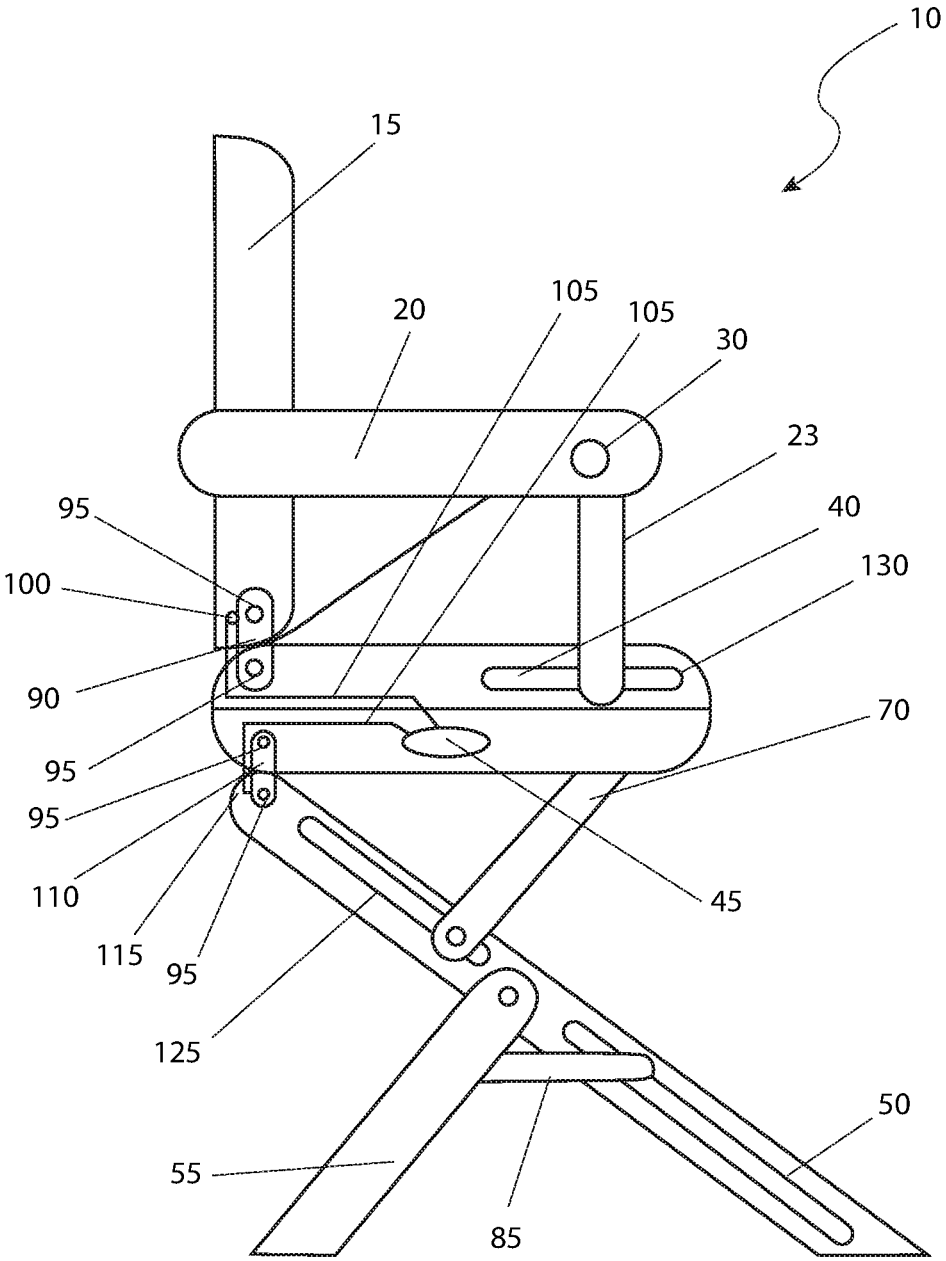

The best mode for carrying out the invention is presented in terms of its preferred embodiment, herein depicted within FIGS. 1-3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

1. Detailed Description of the Figures

Referring now to FIGS. 1 and 2, a perspective view of a folding booster chair 10, in a deployed or unfolded configuration and a folded or collapsed state respectively according to a preferred embodiment of the present device (herein described as the "device") 10 is disclosed. The device 10 has the general appearance of standard highchair with an upper portion having a back rest 15, a first arm 20, a first arm support 23, a second arm 25, a second arm support 27, a teething tube 30, a safety strap 35, a seat 40 and a release mechanism 45.

The back rest 15 is moveably secured at a bottom edge of the back rest 15 to a rear edge of the seat 40. The first arm 20 is perpendicularly and moveably secured at a first end of the first arm 20 to a first side edge of the back rest 15 while the second arm 25 is moveably and perpendicularly secured at a first end of the second arm 25 to a second side edge of the back rest 15 opposite the first arm 20. The first arm support 23 is rotationally and perpendicularly secured at a first end of the first support arm 23 beneath the first arm 20 at a second end of the first arm 20 and rotationally secured to a first side of the seat 40 adjacent a front edge of the seat 40. The second arm support 27 is rotationally and perpendicularly secured at a first end of the second arm support 27 beneath the second arm 25 at a second end of the second arm 25 and rotationally secured to a second side of the seat 40 opposite the first side of the seat 40 adjacent the front edge of the seat 40. Where said back rest 15 and said seat 40 comprise a durable plastic exterior having a soft foam interior.

The teething tube 30 is made of a soft durable exterior material having a solid core and is rotationally secured between the second end of the first arm 20 and the second end of the second arm 25. A safety strap is removably secured to a center portion of the teething tube 30 at a first end of the safety strap 35 and secured to a center portion of the front edge of the seat 40 at a second end of the safety strap 35. The safety strap 35 may comprises a traditionally configured belt and buckle system.

The lower portion of the device 10 comprises a first leg 50, a first lower brace 55, a second lower brace 60, a second leg 65, a first upper brace 70, a second upper brace 75, a first cross brace 80 and a second cross brace 85. In the deployed or open state, the first leg 50 is moveably and radially secured downward at a first end of the first leg 50 beneath the rear edge the seat 40 adjacent the first side of the seat 40. The second leg 65 is moveably and radially secured downward at a first end of the second leg 65 beneath the rear edge the seat 40 adjacent the second side of the seat 40. The first upper brace 70 is moveably and radially secured downward at a first end of the first upper brace 70 beneath the front edge of the seat 40 adjacent the first side of the seat 40 and moveably and radially secured at a second end of the first upper brace 70 to a portion of the first leg 50 adjacent the first end of the first leg 50. The second upper brace 75 is moveably and radially secured downward at a first end of the second upper brace 75 beneath the front edge of the seat 40 opposite the first upper brace 70 adjacent the second side of the seat 40 and moveably and radially secured at a second end of the second upper brace 75 to a portion of the second leg 65 adjacent the first end of the second leg 65. The first lower brace 55 is moveably and radially secured at a first end of the first lower brace 55 to the first leg 50 subjacent the second end of the first upper brace 70. The second lower brace 60 is moveably and radially secured at a first end of the second lower brace 60 to the second leg 65 subjacent the second end of the second upper brace 75. The first cross brace 80 is moveably and horizontally secured at a first end of the first cross brace 80 to the first lower brace 55 adjacent the first end of the first lower brace 55. The second cross brace 85 is moveably and horizontally secured at a first end of the second cross brace 85 to the second lower brace 60 adjacent the first end of the second lower brace 60.

A release mechanism 45, preferably comprising a button, is disposed within a first side of the seat 40. The release mechanism 45 is in mechanical communication with an interior mechanism of the upper portion and lower portion of the device 10 (not shown) which upon activation permits the upper portion and lower portion of the device 10 to be physically manipulated from an open or deployed state as seen in FIG. 1 to a folded or collapsed state as seen in FIG. 2. Also displayed in FIG. 1 is a safety restraint 86 to hold the child into the folding booster chair 10 during use. A cross member support 87 is provide between the first lower brace 55 and the second lower brace 60 to provide lateral stability to the folding booster chair 10.

Referring finally to FIG. 3, a sectional view of a folding booster chair 10, as seen along a line I-I, as shown in FIG. 1, according to a preferred embodiment of the present invention is shown. The back rest 15 is connected to the seat 40 via a first hinge mechanism 90 provided with two (2) pivot points 95. A first slide lock mechanism 100 is then physically interconnect to the release mechanism 45 via mechanical linkage 105. The first slide lock mechanism 100 is envisioned to be of the spring pin variation although other types of lock mechanisms may be utilized, and as such, the specific type of first slide lock mechanism 100 is not intended to limit the scope of the present invention. Likewise, the first leg 50 is connected to the seat 40 via a second hinge mechanism 110, also provided with two (2) pivot points 95. A second slide lock mechanism 115 then physically interconnects to the release mechanism 45 via a mechanical linkage 105 as well. Thus, as the release mechanism 45 is pressed, both the first hinge mechanism 90 and the second hinge mechanism 110 are allowed to release and fold flat as shown in FIG. 2. The second cross brace 85 slides within a lower sliding track 120. In a similar manner the first upper brace 70 slides within an upper sliding track 125. Both the lower sliding track 120 and the upper sliding track 125 allow the device 10 to capsize as shown in FIG. 2. Working in conjunction, an arm support sliding track 130 allows the first arm support 23 to slide as well to allow the back rest 15 and the first arm 20 to fold flat against the seat 40. It is noted that while FIG. 3 portrays one side of the device 10 (only two (2) leg and arm rest supports), the premise and configuration is repeated for both side of the device 10.

2. Utilization of the Preferred Embodiment

The preferred embodiment of the present invention can be utilized by the common user in a simple and effortless manner with little or no training. It is envisioned that the device 10 would be constructed in general accordance with FIGS. 1 and 2.

It is envisioned that the device 10, once procured by a user, is physically manipulated which motions the upper portion and the lower portion of the device 10 apart. Upon sufficient manipulation, the user may lock the device 10 by means of the interior mechanism (not shown) into the open or deployed state (see FIG. 1). Upon actuation of the folding booster chair release mechanism, the interior mechanism (not shown) unlocks so that the device 10 may be physically manipulated through a motion which motions the upper portion and the lower portion of the device 10 into the folded or collapsed state (see FIG. 2).

The invention claimed is:

1. A folding booster chair comprising:

a back rest;

a seat, moveably secured to a rear side of said back rest;

a first arm, moveably secured to a first side of said back rest at a first arm first end;

a second arm, moveably secured to a second side of said back rest at a second arm first end;

a first arm support, moveably secured between said first arm at a first arm second end and a first side of said seat and adjacent a front side of said seat;

a second arm support, moveably secured between said second arm at a second arm second end and a second side of said seat and adjacent a front side of said seat opposite said first arm;

a teething tube, secured between said first arm second end and said second arm second end;

a pair of legs, moveably and radially disposed beneath said rear side of said seat on opposite sides of said rear side of said seat;

a pair of upper braces, each moveably and radially disposed beneath said front side of said seat on opposites sides of said front side of said seat at a respective first end of each said upper brace and moveably secured said pair of legs respectively;

a pair of lower braces, each moveably and radially disposed beneath each respective said pair of legs; and, a pair of cross braces, each moveably disposed between each respective said pair of legs and each said pair of lower braces;

wherein said teething tube is rotationally secured between said first arm second end and said second arm second end; and, wherein said teething tube comprises a soft durable exterior material having a solid core.

2. The booster chair of claim 1, wherein a safety strap is removably secured between said teething tube and said front side of said seat.

3. The booster chair of claim 1, further comprising a safety strap, secured between said teething tube and said front side of said seat.

4. The booster chair of claim 1, wherein said back rest and said seat are secured together by means of a first hinge mechanism.

5. The booster chair of claim 4, wherein a first leg and said seat are secured together by means of a second hinge mechanism.

6. The booster chair of claim 5, wherein said first hinge mechanism and said second hinge mechanism is capable of being secured in a locked position.

7. The booster chair of claim 6, wherein said back rest comprises a pliable plastic surface and foam interior.

8. The booster chair of claim 7, wherein said seat comprises a pliable plastic surface and foam interior.

9. The booster chair of claim 1, wherein said back rest and said seat are secured together by means of a first hinge mechanism.

10. The booster chair of claim 9, wherein a first leg and said seat are secured together by means of a second hinge mechanism.

11. The booster chair of claim 9, further comprising a first slide lock in mechanical communication with said first hinge and said release mechanism.

12. The booster chair of claim 11, further comprising a second slide lock in mechanical communication with said second hinge and said release mechanism.

13. The booster chair of claim 12, wherein said first slide lock and said second slide lock each comprise a spring pin.

14. A folding booster chair comprising:

a back rest;

a seat, moveably secured to a rear side of said back rest;

a first arm, moveably secured to a first side of said back rest at a first arm first end;

a second arm, moveably secured to a second side of said back rest at a second arm first end;

a first arm support, moveably secured between said first arm at a first arm second end and a first side of said seat and adjacent a front side of said seat;

a second arm support, moveably secured between said second arm at a second arm second end and a second side of said seat and adjacent a front side of said seat opposite said first arm;

a teething tube, secured between said first arm second end and said second arm second end;

a pair of legs, moveably and radially disposed beneath said rear side of said seat on opposite sides of said rear side of said seat;

a pair of upper braces, each moveably and radially disposed beneath said front side of said seat on opposites sides of said front side of said seat at a respective first end of each said upper brace and moveably secured said pair of legs respectively;

a pair of lower braces, each moveably and radially disposed beneath each respective said pair of legs;

a pair of cross braces, each moveably disposed between each respective said pair of legs and each said pair of lower braces; and, a release mechanism disposed within said first side of said seat;

wherein actuation of said release mechanism engages the release of a locking mechanism permitting said booster chair to be manipulated to a folded state;

wherein said teething tube is rotationally secured between said first arm second end and said second arm second end; and, wherein said teething tube comprises a soft durable exterior material having a solid core.

15. The booster chair of claim 14, wherein a safety strap is removably secured between said teething tube and said front side of said seat.

16. The booster chair of claim 14, further comprising a safety strap, secured between said teething tube and said front side of said seat.

* * * * *